US005442899A

United States Patent [19]

Shibazaki et al.

[11] Patent Number: 5,442,899

[45] Date of Patent: Aug. 22, 1995

[54] BAND CHARGING APPARATUS FOR PACKING MACHINE

[75] Inventors: Tokio Shibazaki, Osaka; Seiichiro Koyama, Tokyo; Kenichi Enda, Kanagawa; Yoshikatsu Aizawa, Saitama; Hiroshi Furukawa, Tokyo, all of Japan

[73] Assignee: Strapack Corporation, Tokyo, Japan

[21] Appl. No.: 88,431

[22] Filed: Jul. 7, 1993

[30] Foreign Application Priority Data

Jul. 10, 1992 [JP] Japan ..... 4-183906

[51] Int. Cl.[6] ..... B65B 13/04

[52] U.S. Cl. ..... 53/589; 53/389.4

[58] Field of Search ..... 53/389.21, 389.4, 582, 53/589; 100/26, 32

[56] References Cited

U.S. PATENT DOCUMENTS

| | | | |
|---|---|---|---|
| 4,885,901 | 12/1989 | Sakaki et al. | 53/589 |
| 5,236,329 | 8/1993 | Sylvester | 53/589 X |

FOREIGN PATENT DOCUMENTS

| | | | |
|---|---|---|---|
| 59-5494 | 2/1984 | Japan . | |
| 60-92904 | 6/1985 | Japan . | |
| 153414 | 6/1989 | Japan | 100/32 |
| 403111219 | 5/1991 | Japan | 100/26 |

*Primary Examiner*—Linda Johnson

*Attorney, Agent, or Firm*—Steinberg, Raskin & Davidson

[57] ABSTRACT

A band charging apparatus for a packing machine capable of carrying out charging of a band while effectively preventing jamming of the band. In the packing machine, a band unwound from a reel is fed to a pool box by means of the band charging apparatus, to thereby be temporarily stored in the pool box. Then, the band is fed to a circumference of a package by means of a band feeding and tightening apparatus. Thereafter, the band is drawn back by means of the band feeding and tightening apparatus while a distal end of the band is kept gripped, resulting in being tightly wound on the package. The band charging apparatus includes a pool feed roller for carrying out feeding of the band to the pool box and a pool touch roller arranged so as to access to the pool feed roller through the band. Also, the band charging apparatus includes guide plates for defining a band guide path in the pool box when the band is set for charging of the band in the band feeding and tightening apparatus. The guide plates are pivotally moved in a direction of guiding the band, to thereby close the guide plates. When the band is excessively fed to the band guide path, nerve of the band in the band guide path causes the guide plates to be open, to thereby release the band guide path, resulting in the band being stored in the pool box.

9 Claims, 13 Drawing Sheets

BAND CHARGING APPARATUS FOR PACKING MACHINE

BACKGROUND OF THE INVENTION

This invention relates to a band charging apparatus for a packing machine for winding a band on a package such as a box or the like, and more particularly to a band charging apparatus which is adapted to feed a band unwound from a reel to a pool box to temporarily store it therein and then feed it to a band feeding and tightening apparatus to charge it therein. Subsequently, the band is fed to a circumference of the package by means of the band feeding and tightening apparatus, which then draws back the band while gripping a distal end of the band to wind the band on the package and tighten it. Then, an overlapped portion of the band is bonded and a portion of the band wound on the package is cut from the remaining part of the band.

A conventional packing machine is generally constructed so as to feed a band unwound from a reel to a pool box provided in the packing machine by cooperation of a pool feed roller of a band charging apparatus and a pool touch roller thereof. The band thus temporarily stored in the pool box is fed to a band feeding and tightening apparatus.

The band feeding and tightening apparatus includes a plurality of pairs of rollers for feeding the band to a circumference of a package. Feeding of the band to the package is carried out by means of an arch structure provided on a table on which the package is placed. More particularly, the arch structure and table are provided with band passages through which the band is fed to the circumference of the package while being formed into an annular shape.

Subsequently, a band gripping and bonding apparatus grasps a distal end of the band and then a return roller provided in the band feeding and tightening apparatus applies a band drawing-back force to the band, resulting in the band being drawn back. The arch structure and table are formed on an inner peripheral surface thereof with a slit, so that the above-described application of the band drawing-back force to the band fed to the arch structure and table causes the band to rush out of the slit, resulting in the band being wound on the package.

The band is then further tightened by a tension roller provided in the band feeding and tightening apparatus. Then, the band is bonded at an overlapped portion thereof by welding or the like by means of the band gripping and bonding apparatus while being kept tightened. Thereafter, the band is cut at a portion thereof wound on the package from the remaining part of the band.

The conventional band charging apparatus described above is disclosed in Japanese Patent Publication No. 5494/1984. Also, Japanese Utility Model Application Laid-Open Publication No. 92904/1985 discloses an improvement in the band charging apparatus disclosed in Japanese Patent Publication No. 5494/1984.

Now, the band charging apparatus disclosed in Japanese Utility Model Application Laid-Open Publication No. 92904/1985 will be described hereinafter with reference to FIGS. 13 and 14.

The band charging apparatus, as shown in FIG. 13, includes a band guide plate means 8 which is adapted to guide a band 1 when the band 1 unwound from a reel (not shown) is fed to a band feeding and tightening apparatus (not shown). For this purpose, the band 1 is guided through a band inlet port 4*a* into the band guide plate means 8 by means of a pair of pool rollers 5 and then fed from a band outlet port 4*b* through a band passage 8' to the band feeding and tightening apparatus by means of a pair of feed rollers 7, resulting in being charged in the band feeding and tightening apparatus. When charging of the band 1 in the band feeding and tightening apparatus is completed, the band guide plate means 8 is rendered open, so that the band 1 is stored in a pool box 4. The pool box 4 is formed into a small thickness so as to correspond to a thickness of the band 1, so that the band 1 is stored in the pool box 4 while being folded in due turn, resulting in entangling of the band in the pool box being effectively prevented.

The band guide plate means 8, as shown in FIG. 14, is constructed so as to be pivotally moved about a shaft 8*a* mounted on a side wall 3 of the pool box 4. The band guide plate means 8 includes a distal end 8*b*, which is positioned in proximity to a side wall of the pool box 4 opposite to the side wall 3 of the pool box 4 when the band guide plate means 8 is kept closed. This causes the band guide plate means 8 to form a band guide passage 6 between the guide plate means 8 and a rear wall 9 of the pool box 4 at an upper end of the pool box 4, resulting in the band 1 being guided in the passage 6. When the band guide plate means 8 is rendered open to release the band guide passage 6, the band 1 is stored in the pool box 4 as indicated at two-dot chain lines in FIGS. 13 and 14.

Unfortunately, the conventional band charging apparatus requires that when the band 1 is guided along the band guide pate means 8, to thereby be charged in the band feeding and charging apparatus, an operator manually opens the band guide plate means 8 after confirming completion of the charging. The confirmation is highly troublesome. Also, in the conventional band charging apparatus, it is highly difficult to open the band guide plate means 8 in time with the confirmation. If opening of the band guide plate means 8 is delayed, there occurs a possibility of causing jamming of the band at a position where the band is forwardly moved from the band feeding and tightening apparatus. The jamming prevents smooth drawing-back of the band.

SUMMARY OF THE INVENTION

The present invention has been made in view of the foregoing disadvantage of the prior art.

Accordingly, it is an object of the present invention to provide a band charging apparatus for a packing machine which is capable of carrying out charging of a band while effectively preventing jamming of the band.

It is another object of the present invention to provide a band charging apparatus for a packing machine which is capable of permitting a band guide passage formed in a pool box only when setting for charging of a band in a band feeding and tightening apparatus is carried out to be released in time with charging of the band in the band feeding and tightening apparatus.

In accordance with the present invention, a band charging apparatus is provided for a packing machine adapted to feed a band unwound from a reel to a pool box by means of the band charging apparatus for temporarily storing the band in the pool box, feed the stored band to a band feeding and tightening apparatus by means of the band charging apparatus for charging the band feeding and tightening apparatus with the band, feed the band to a circumference of a package by means of the band feeding and tightening apparatus, draw back the band by means of the band feeding and tightening apparatus while gripping a distal end of the band for tightly winding the band on the package, bond an overlapped portion of the band, and cut a portion of the band wound on the package from the remaining part of the band. The band charging apparatus includes a pool feed roller for carrying out feeding of the band to the pool box, a pool touch roller arranged so as to access to the pool feed roller through the band, guide plates for defining a band guide path in the pool box when the band is set for charging of the band in the band feeding and tightening apparatus, a first mechanism for pivotally moving at least one of the guide plates in a direction of guiding the band to openably operate the at least one guide plate, a second mechanism for closing the at least one guide plate to form the band guide path, and a third mechanism for keeping the at least one guide plate closed, as well as permitting nerve of the band to open the at least one guide plate to release the band guide path when the band is excessively fed to the band guide path.

In the band charging apparatus of the present invention constructed as described above, when a band is newly set for charging of the band in the band feeding and tightening apparatus, the pool feed roller and pool touch roller cooperate to each other to guide a distal end of the band to the band guide path defined by the guide plates closed. At this time, the guide plates are kept closed by the third mechanism. Then, when the band is excessively fed to the band guide path, nerve of the band causes the third mechanism to be operated, to thereby render the guide plates open, resulting in the band guide path being released. This causes the band to be stored in the pool box, so that setting of the band for charging of the band in the band feeding and tightening apparatus is completed. Thereafter, the band set is subject to feeding, drawing-back and tightening in the band feeding and tightening apparatus, resulting in being wound on a package.

In a preferred embodiment of the present invention, the second mechanism includes at least one rod arranged so as to carry out advance and retreat. The rod advances to force the at least one guide plate in a direction of closing the at least one guide plate and then retreats. Also, the third mechanism comprises at least one magnet for keeping the at least one guide plate closed. When elastic force of the magnet is defeated by nerve of the band excessively fed to the band guide path, the guide plates are pivotally moved to release the band guide path. The second mechanism for closing the guide plates to form the band guide path advances to force the guide plate in a direction of closing the guide plates.

In a preferred embodiment of the present invention, the advance and retreat of the rod are carried out in association with access of said pool touch roller to said pool feed roller.

In a preferred embodiment of the present invention, association between the advance and retreat of the rod and the access of the pool touch roller to the pool feed roller is carried out by connecting a handle lever for permitting the pool touch roller to access to the pool feed roller and the rod to each other through a wire tube unit.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a band charging apparatus for a packing machine according to the present invention will be described hereinafter with reference to FIGS. 1 to 12.

First, a packing machine to which a band charging apparatus of the present invention is applied will be described.

Figure 1:
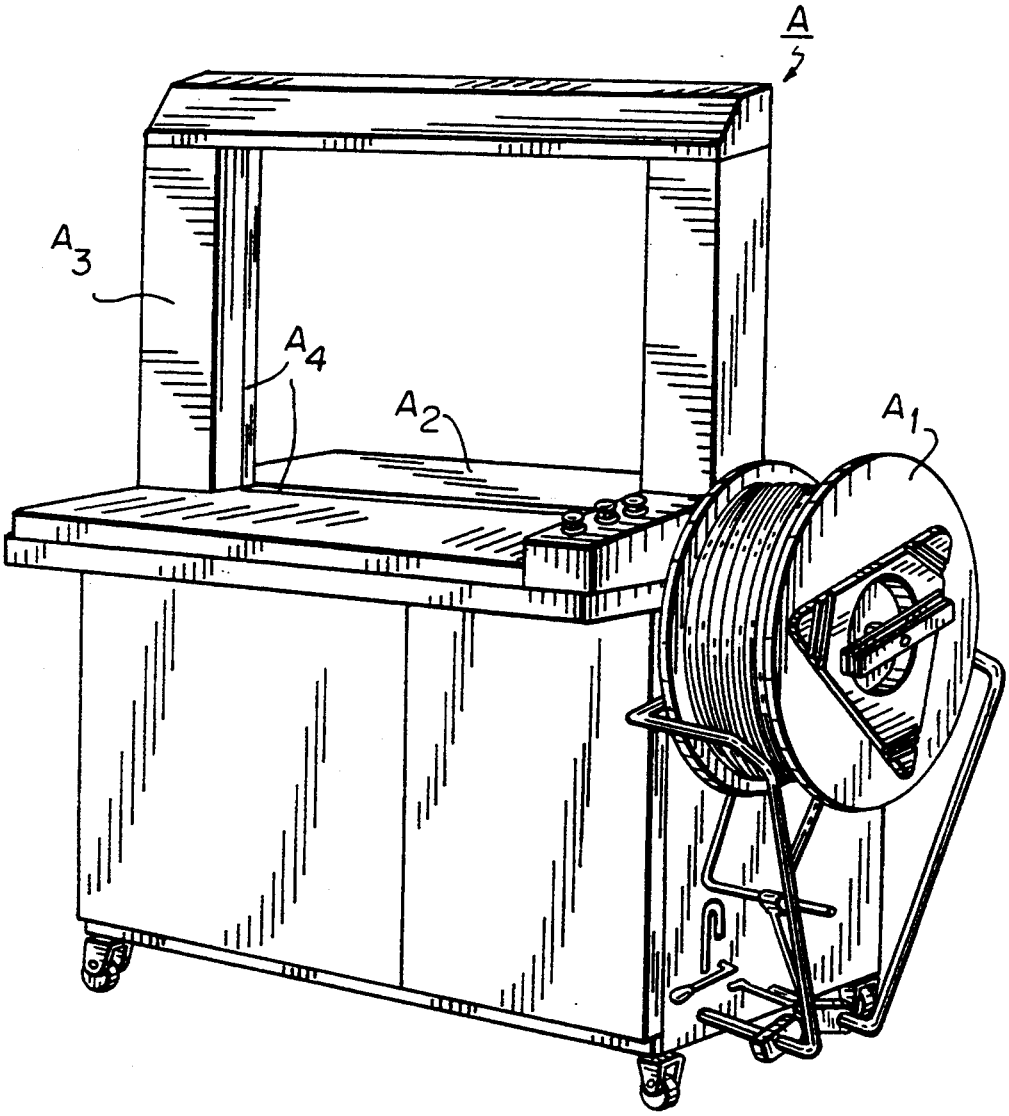
FIG. 1 is a schematic perspective view generally showing an embodiment of a band charging apparatus for a packing machine according to the present invention.
Figure 2:
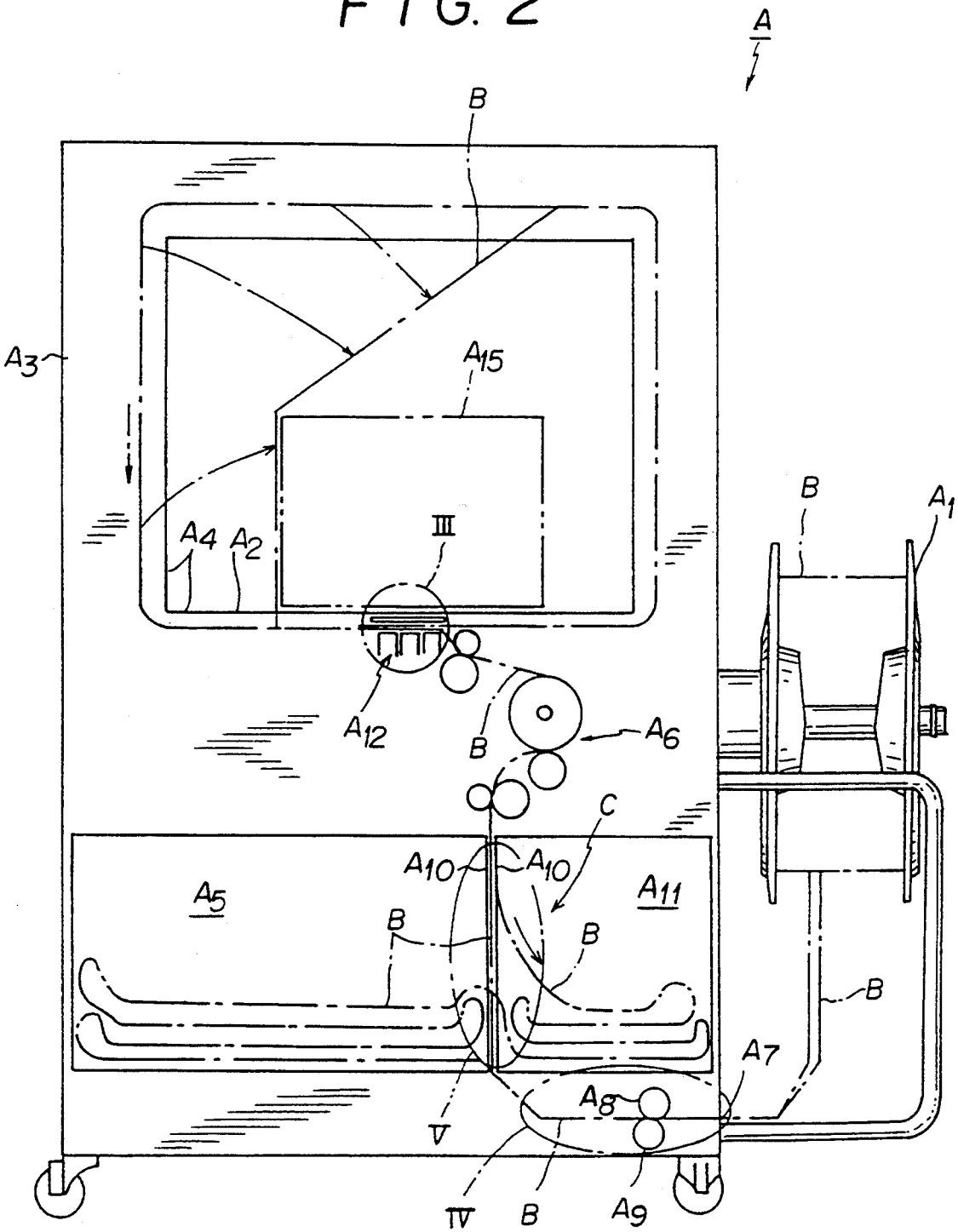
FIG. 2 is a schematic vertical sectional view of the band charging apparatus shown in FIG. 1.

Referring first to FIGS. 1 and 2, a packing machine A to which an embodiment of a band charging apparatus according to the present invention is applied is illustrated. The packing machine A includes a reel A1 on which a band B (FIG. 2) is wound and a table A2 on which a package A15 (FIG. 2) such as a box or the like is placed. The table A2 is provided thereon with an arch structure A3. The arch structure A3 and table A2 cooperate with each other to provide an annular inner periphery, which is formed with a slit A4 for receiving the band B therein. Application of band drawing-back force to the band causes the band to rush out of the slit A4, resulting in the band being fed to a circumference of the package. The packing machine A is provided therein with a pool box A5 for temporarily storing the band B therein and a band charging apparatus C of an embodiment of the present invention.

Now, the manner of operation of the packing machine A constructed as described above will be described with reference to FIG. 2.

The band B unwound from the reel A1 is introduced at a distal end thereof through a band inlet A7 into the band charging apparatus C and pressedly contacted with a pool feed roller A8 by means of a pool touch roller A9, so that the band B is upwardly directed along a band passage defined in the pool box A5. The band passage is formed by a pair of guide plates A10 openably arranged. More particularly, the guide plates A10 are constructed so as to be pivotally moved about an axis extending in parallel with the sheet of FIG. 2, resulting in being open, after the band B is fed at the distal end thereof to a band feeding and tightening apparatus A6. This permits the band B to access to the pool box A5 and a back pool box A11.

The pool box A5 functions to temporarily store therein the band B fed thereto by means of the pool feed roller A8. The back pool box A11 serves to store therein the band B drawn back by the band feeding and tightening apparatus A6.

The band feeding and tightening apparatus A6 functions to feed the band B into the arch structure A3 at a high speed, draw back the band B while the distal end of the band B is kept gripped, and then tighten it. For this purpose, the table A2 is provided at a central portion thereof positioned under the slit A4 with a band gripping and bonding apparatus A12 for gripping the distal end of the band B and bonding an overlapped portion of the band by welding.

Figure 3:
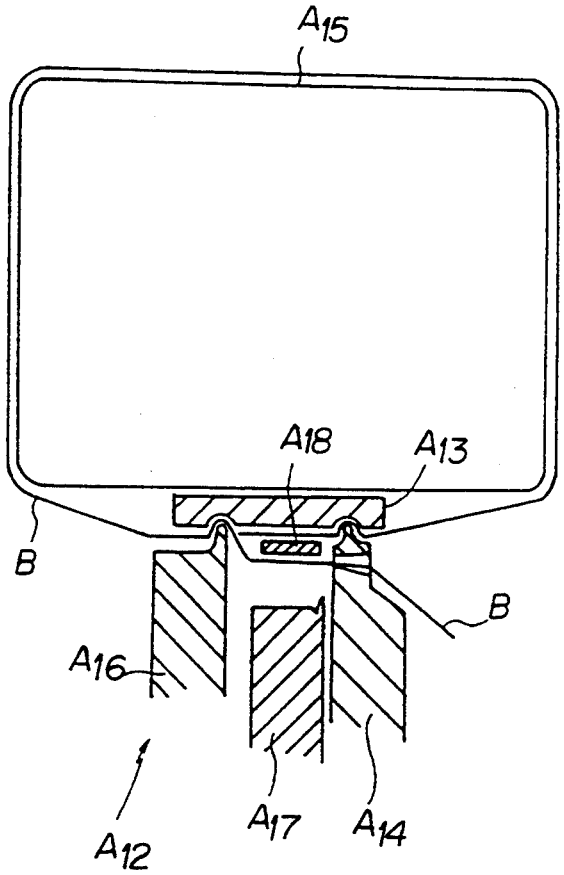
FIG. 3 is an enlarged sectional view showing a part encircled by dashed lines III in FIG. 2.
Figure 13:
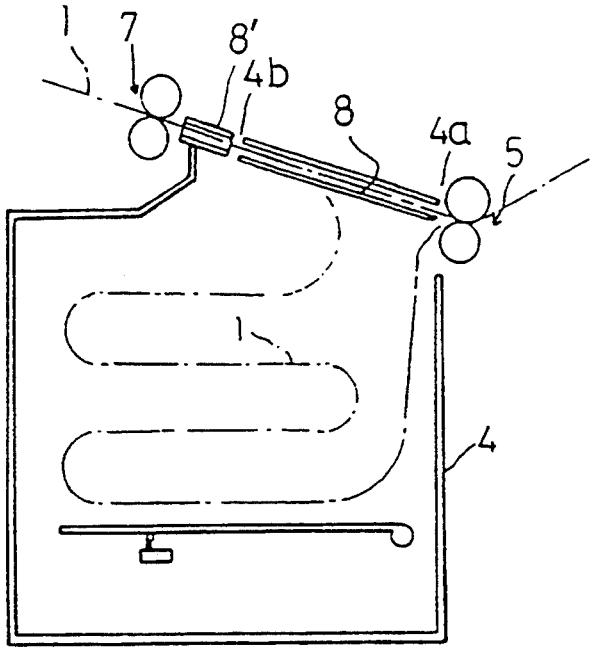
FIG. 13 PRIOR ART
FIG. 13 is a schematic sectional view showing a conventional band charging apparatus.
Figure 14:
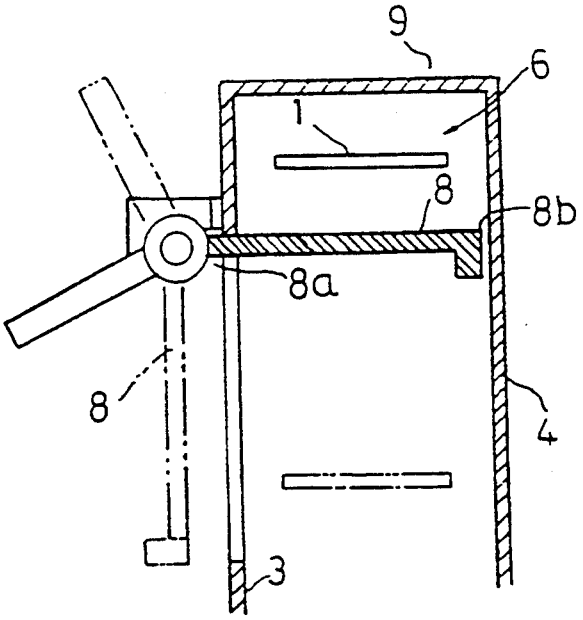
FIG. 14 PRIOR ART
FIG. 14 is a fragmentary sectional view showing an upper portion of the conventional band charging apparatus of FIG. 13.

The band gripping and bonding apparatus A12 may be constructed in such a manner as shown in FIG. 3. More particularly, the band B fed to the arch structure A3 (FIG. 2) and encircled in the arch structure is pressed at the distal end thereof against a lower surface of a slide table A13 by means of a right-hand block A14 upwardly moved, to thereby be grasped. Then, the band B is drawn back. This causes the band B to rush out of the slit A, resulting in being wound on the package A15. Subsequently, a left-hand block A 16 is upwardly moved to press the band B against the slide table A13, to thereby keep the band tightened. Thereafter, an intermediate block A17 is upwardly moved to cut a portion of the band B wound around the package A15 from the remaining part of the band. Then, a heater A18 heats the overlapped portion of the band A13 to melt it and then is caused to retreat in a direction perpendicular to the sheet of FIG. 3. Subsequently, the intermediate block A17 is further upwardly moved to press the overlapped portion of the band B against the slide table A13 to bond it by welding. Finally, the blocks A14, A16 and A18 are lowered and the slide table A13 is caused to retreat in the direction perpendicular to the sheet of FIG. 13.

Now, the band charging apparatus C of the illustrated embodiment will be described hereinafter with reference to FIGS. 4 to 11.

First, a general structure of the band charging apparatus C will be described.

In order to feed the band unwound from the reel A1 (FIG. 2) into the pool box A5, the pool feed roller A8 is arranged and the pool touch roller A9 is provided so as to access to the pool feed roller A8 through the band B. The band passage through which the band B fed by the rollers A8 and A9 passes is provided at an intermediate portion thereof positioned in the pool box A5 with a band guide path 53. The band guide path 53 is formed only when setting of a new band in the band charging apparatus C is carried out. The band guide path 53 is defined by the guide plates A10. For the purpose, the guide plates A10 are pivotally moved in a direction of guiding the band by means of hinges 127*a* and 127*b*, resulting in being open. The guide plates A10 are closed by rods 129*a* and 129*b* which are arranged so as to be retractably moved by means of a wire tube unit. Also, the guide plates A10 are provided with magnets 66*a* and 66*b* acting as a holding and releasing means for maintaining or releasing the band guide path 53. The wire tube unit is connected to a handle lever 146 for accessibly moving the pool touch roller A9 with respect to the pool feed roller A8.

Now, the band charging apparatus C will be described more detailed.

Figure 5:
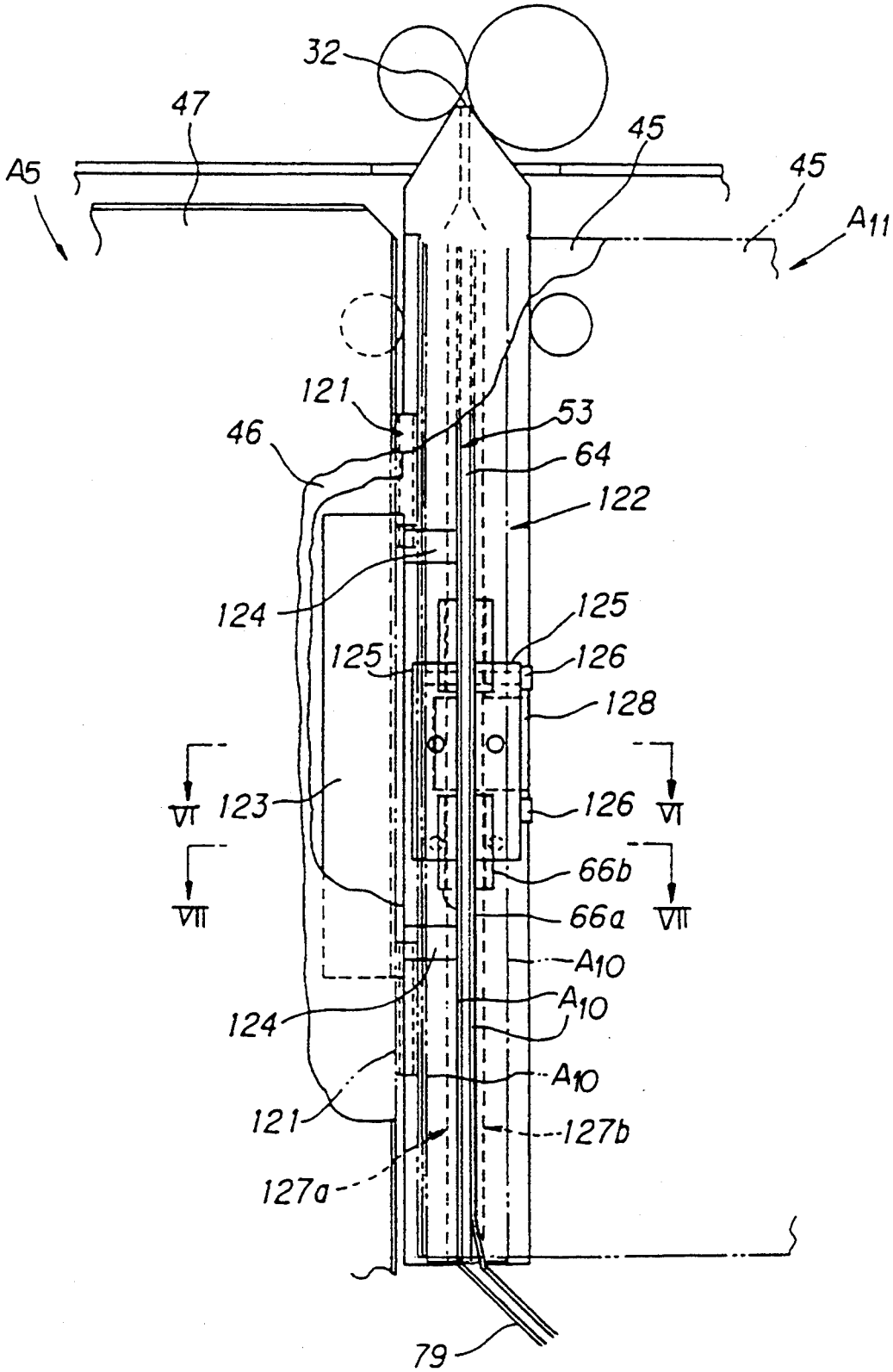
FIG. 5 is an enlarged view showing a part encircled by dashed line V in FIG. 2.
Figure 6:
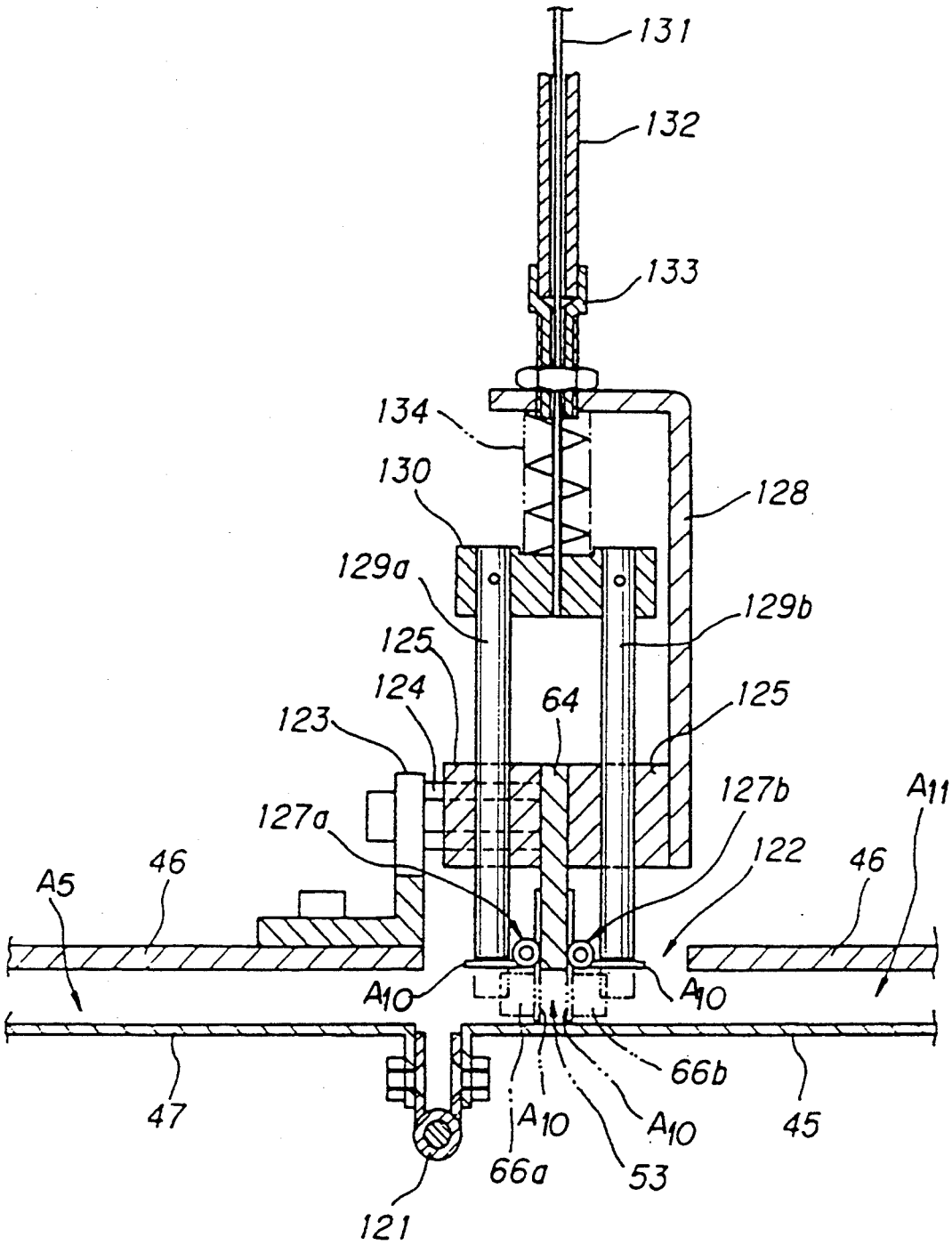
FIG. 6 is a sectional view taken along line VI—VI of FIG. 5.

As shown in FIGS. 5 and 6, the pool box A5 and back pool box A11 include an outer wall 47 and an outer wall 45, respectively, which have inner surfaces formed so as to be flush with each other. Also, the pool box A5 and back pool box A11 include inner walls 46, respectively, which are arranged so as to be opposite to the outer walls 47 and 45 at predetermined intervals and flush with each other. This results in the pool box A5 and back pool box A11 communicating with each other while keeping the outer walls 47 and 45 and the inner walls 46 flush with each other, respectively. The outer walls 47 and 45 are provided at portions thereof adjacent to each other with flanges of an L-shape in section in a manner to be opposite to each other, which are connected to each other by means of two hinges 121, so that one of the outer walls 47 and 45 may be openable. In the illustrated embodiment, the outer wall 45 of the back pool box A11 is rendered openable.

Also, between the inner wall 46 of the pool box A5 and the inner wall 46 of the back pool box A11 is defined an elongated space 122 of a rectangular shape which is formed so as to longitudinally extend. One of ends of the inner walls 46 opposite to each other is fixedly mounted with a bracket 123 of an L-shape in section. The bracket 123 is mounted with an elongated hinge mounting plate 64 through two rod-like support filaments 124 of a hexagonal shape in section. The hinge mounting plate 64 is positioned at a center of the space 122 in such a manner that a longitudinal axis of the plate 64 extends perpendicular to a direction in which the inner walls 46 extend. Such arrangement of the hinge mounting plate 64 permits a distal end of the hinge mounting plate 64 and the outer wall 45 of the back pool box A11 opposite to the distal end of the hinge mounting plate 64 to cooperate with each other to define one of two pairs of opposite walls which form the above-described band guide path 53. Also, the hinge mounting plate 64 is fixedly mounted on both side surfaces thereof with the hinges 127*a* and 127*b* described above, to thereby permit the two guide plates A10 to be pivotally moved. When the guide plates A10 are closed to face each other, they define the other of two pairs of opposite walls forming the above-described band guide path 53. Thus, it will be noted that the guide plates A10 and a combination of the outer wall 45 with the hinge mounting plate 64 cooperate with each other to define the band guide path 53. The band guide path 53 thus formed communicates at one end thereof with an outlet of a band chute 79 and at the other end thereof with an band outlet 32 as shown in FIG. 5.

The guide plates A10, as described above, are provided thereon with the magnets 66*a* and 66*b*. More particularly, the magnets 66*a* and 66*b* are arranged on a central portion of the guide plates A10 in a longitudinal direction thereof so as to be positioned on an outside of the guide plates A10. The magnets 66a and 66b each are formed into a rectangular shape in section. The magnets 66a and 66b attract each other to keep the guide plates A10 closed. Magnetic force generated by the magnets 66a and 66b is determined to a level sufficient to be defeated by nerve or elastic force which the band exhibits when the band undulates in the band guide path 53 due to excessive feeding thereto.

The hinge mounting plate 64 is securely mounted on both sides of a substantially central portion thereof with a guide member 125 of a rectangular shape in section by means of two bolts 126. The guide member 125 is formed with two through-holes, via which rods 129a and 129b are slidably inserted, respectively. The rods 129a and 129b each are so arranged that one end thereof forces the corresponding guide plate A10 when the rod is advanced. Also, the rods 129a and 129b each have the other end integrally connected to one end of a rod joint 130. The guide member 125 is mounted on one side thereof with one end of a wire bracket 128. The wire bracket 128 is formed into an L-shape in section. The L-shaped wire bracket 128 is arranged so that the other end thereof is positioned rearward of the rod joint 130. Between the rod joint 130 and the wire bracket 128 is interposedly provided a rod spring 134, so that the rod joint 130 and the rods 129a and 129b may be constantly forced in a direction of advance thereof.

The wire bracket 128 is provided with a wire 131 in a manner to be inserted therethrough, which is then arranged so as to extend through the rod spring 134. Then, the wire 131 is fixed at one end thereof to the rod joint 130. The wire 131 is also inserted through a wire tube 132. The wire tube 132 is fixed at one end or a distal end thereof on the wire bracket 128 by means of a tube receiving fitment 133. Normally or except the case that a new band is set, the wire 131 functions to rearwardly pull the rods 129a and 129b against the rod spring 134, so that the rods 129a and 129b each are caused to retreat at the distal end thereof to the position at which the guide plates A10 are kept open.

Figure 7:
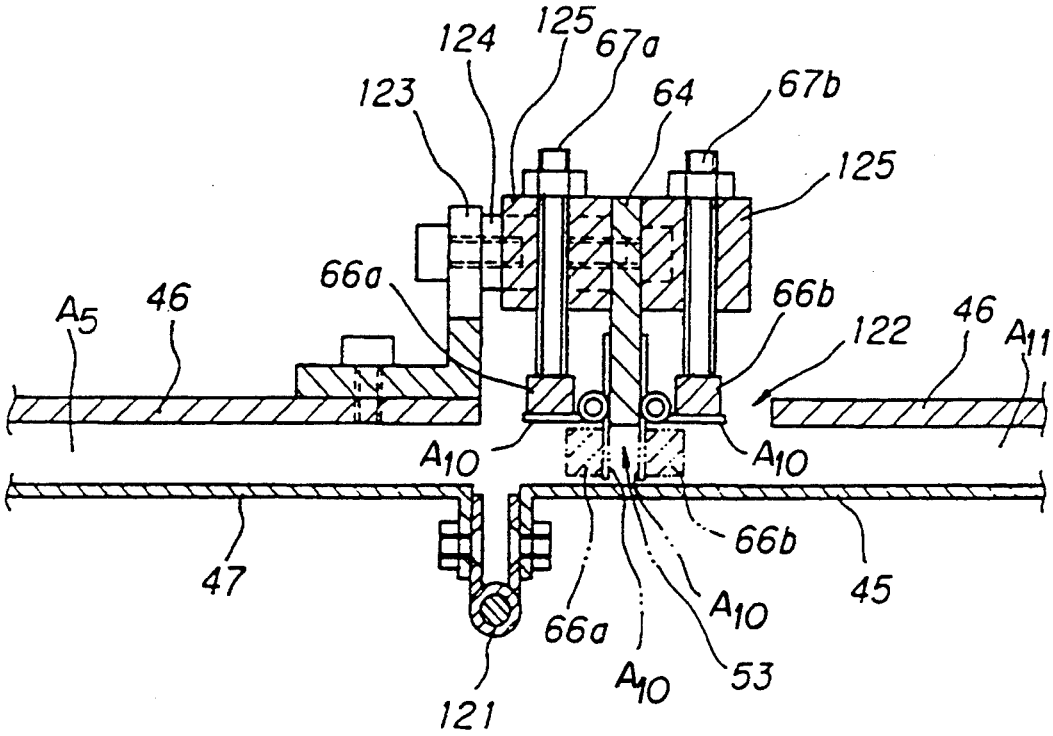
FIG. 7 is a sectional view taken along line VII—VII of FIG. 5.
Figure 8:
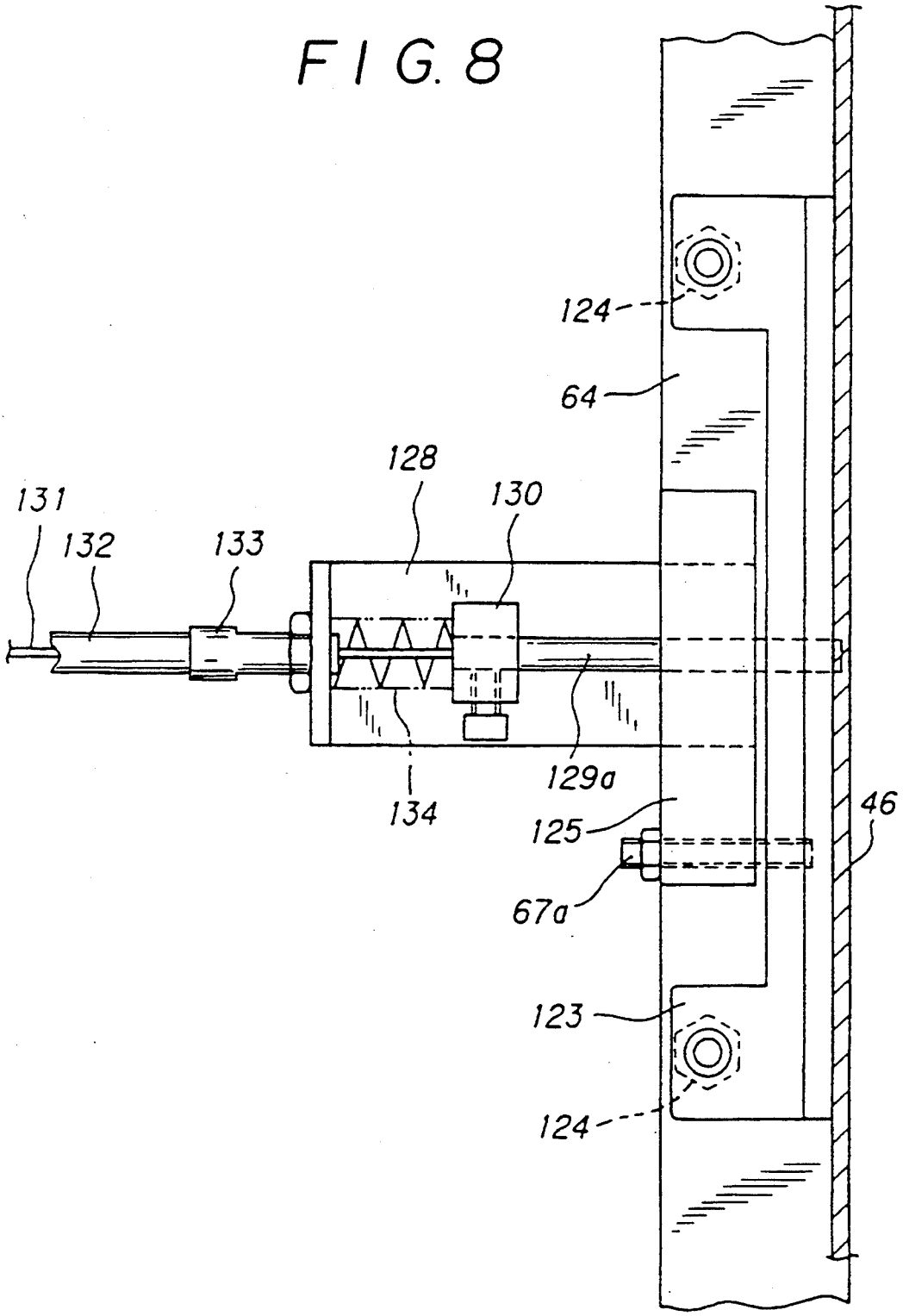
FIG. 8 is a side elevation view of FIG. 6.

In the illustrated embodiment, the guide plates A10 are prevented from being rendered open by an angle above 180 degrees. For this purpose, stoppers 67a and 67b are provided as shown in FIG. 7. More particularly, the stoppers 67a and 67b each may comprise a conventional bolt made of a magnetic material and are threadedly fitted in a threaded hole formed in the guide member 125. The amount of projection of the stoppers 67a and 67b is determined so as to permit the guide plates A10 to be open by an angle of 180 degrees with respect to each other when the magnets 66a and 66b are respectively attracted by distal ends of the stoppers 67a and 67b.

Figure 4:
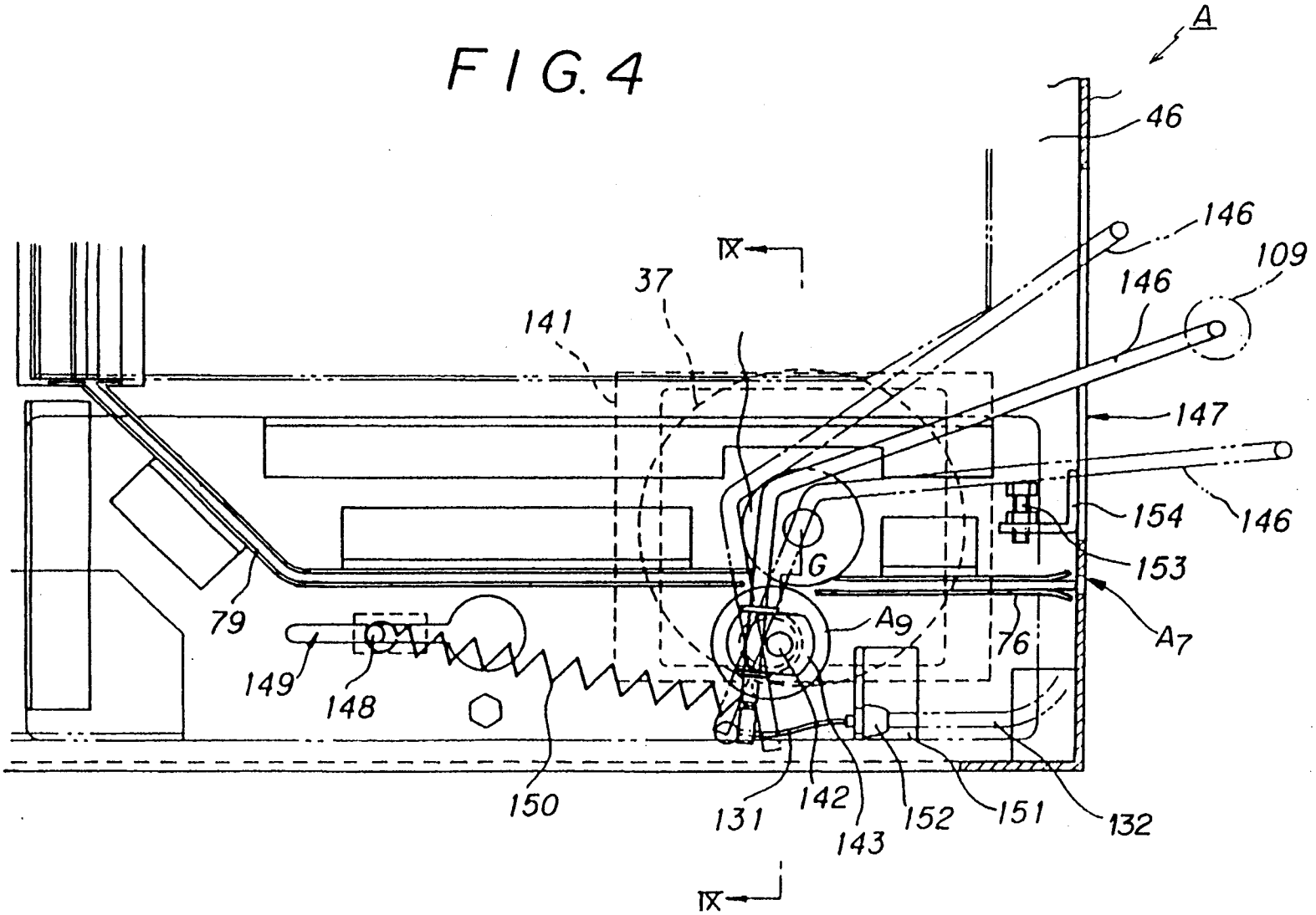
FIG. 4 is an enlarged view showing a part encircled by dashed lines IV in FIG. 2.

The band inlet A7 described above is formed at an outer wall 171 of the packing machine A as shown in FIG. 4. The band inlet A7 is arranged so as to communicate with a pull chute 76 provided in the packing machine A. Then, the pull chute 76 communicates with a band chute 79 likewise provided in the packing machine A. The above-described pool feed roller A8 and pool touch roller A9 are arranged between the pull chute 76 and the band chute 79 in a manner to be opposite to each other.

Figure 9:
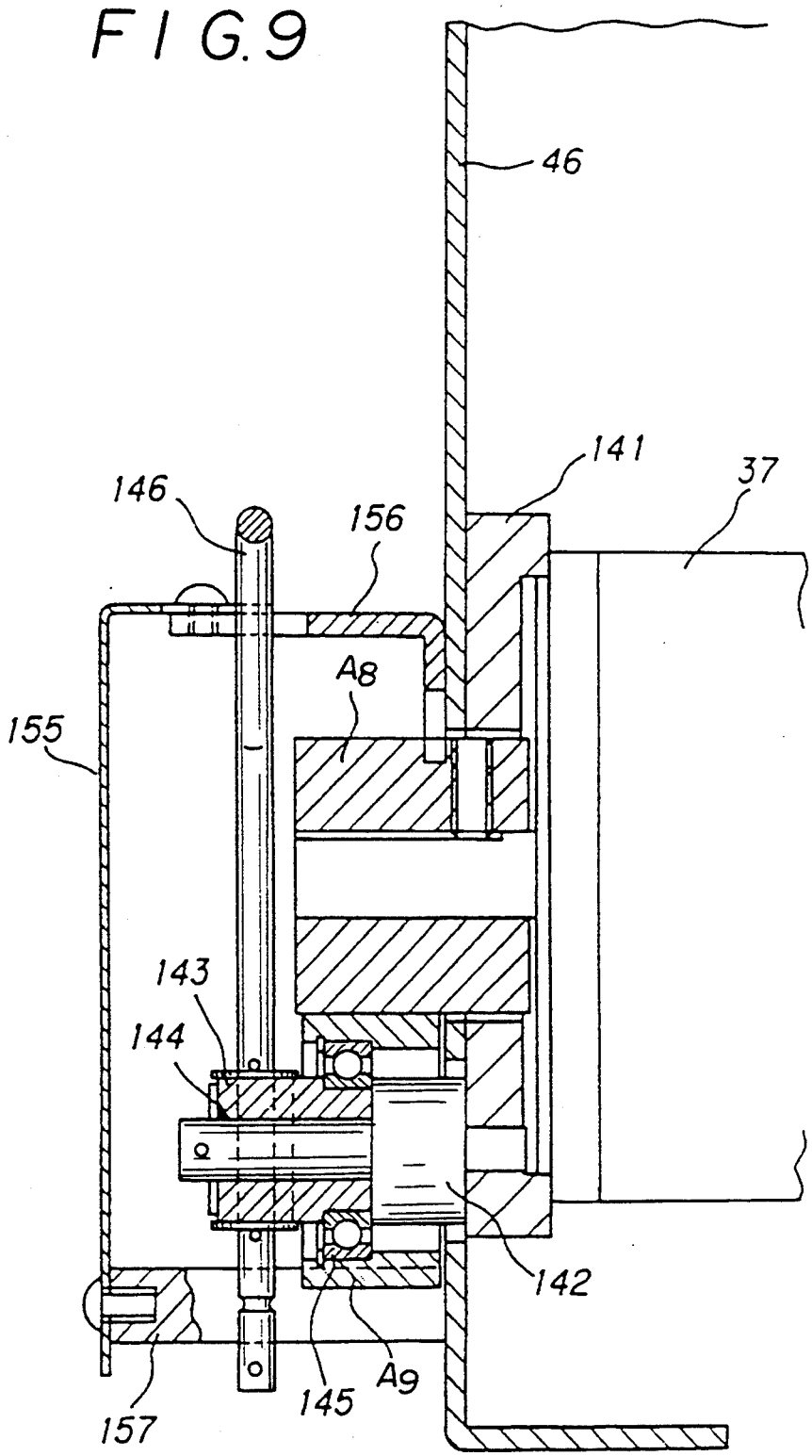
FIG. 9 is a sectional view taken along line IX—IX of FIG. 4.

The pool feed roller A8, as shown in FIG. 9 which is a sectional view taken along line IX—IX of FIG. 4, is mounted on a drive shaft of a pool motor 37 equipped with a reducer. The pool motor 37 is fixedly mounted on the inner wall 46 of the pool box A5 by means of a motor holder 141. The motor holder 141 is fixedly mounted thereon with a shaft 142 so as to be positioned below the pool feed roller A8. The shaft 142 is fitted on a distal end thereof with an eccentric shaft 143 through an eccentric hole 144 formed through the eccentric shaft 143. The above-described pool touch roller A9 is fittedly supported on the eccentric shaft 143 through a bearing 145. Also, the eccentric shaft 143 is formed with a through-hole so as to extend in a direction perpendicular to the eccentric hole 144. The through-hole of the eccentric shaft 143 is fittedly mounted therein with an end of a handle lever 146 of a substantially L-shape in such a manner that the handle lever 146 is rotated in the through-hole. The pool feed roller A8 and pool touch roller A9 are covered with a pool roller cover 155, which is fixedly mounted on the inner wall 46 of the pool box A5 by means of a bracket 156.

The handle lever 146 has one end portion or a lower end portion downwardly extending in the packing machine A, to which one end of a pool roller spring 150 is connected. The pool roller spring 150 is engaged at the other end with a hook 148. This causes the eccentric shaft 134 to be constantly urged in a clockwise direction in FIG. 4. Such urging results in the pool touch roller A9 being constantly forced in a direction of contacting with the feed roller A8. The hook 148 is adapted to be moved in an elongated cutout 149 formed at the inner wall 46, so that a position at which the hook 148 is to be fixed may be adjusted. This permits elastic force of the pool roller spring 150 to be adjusted as desired. The pool roller spring 150 arranged between the hook 148 and the handle lever 146 is constructed so as to exhibit elastic force larger than that of the rod spring 134.

The lower end portion of the handle lever 146 is mounted on a side thereof opposite to the pool roller spring 150 with a wire bracket 151. The wire bracket 151 functions to fix the wire tube 132 of the wire tube unit by means of a tube receiving fitment 152. Also, the wire 131 extending through the wire tube 132 is securely connected to the lower end portion of the handle lever 146.

Figure 10:
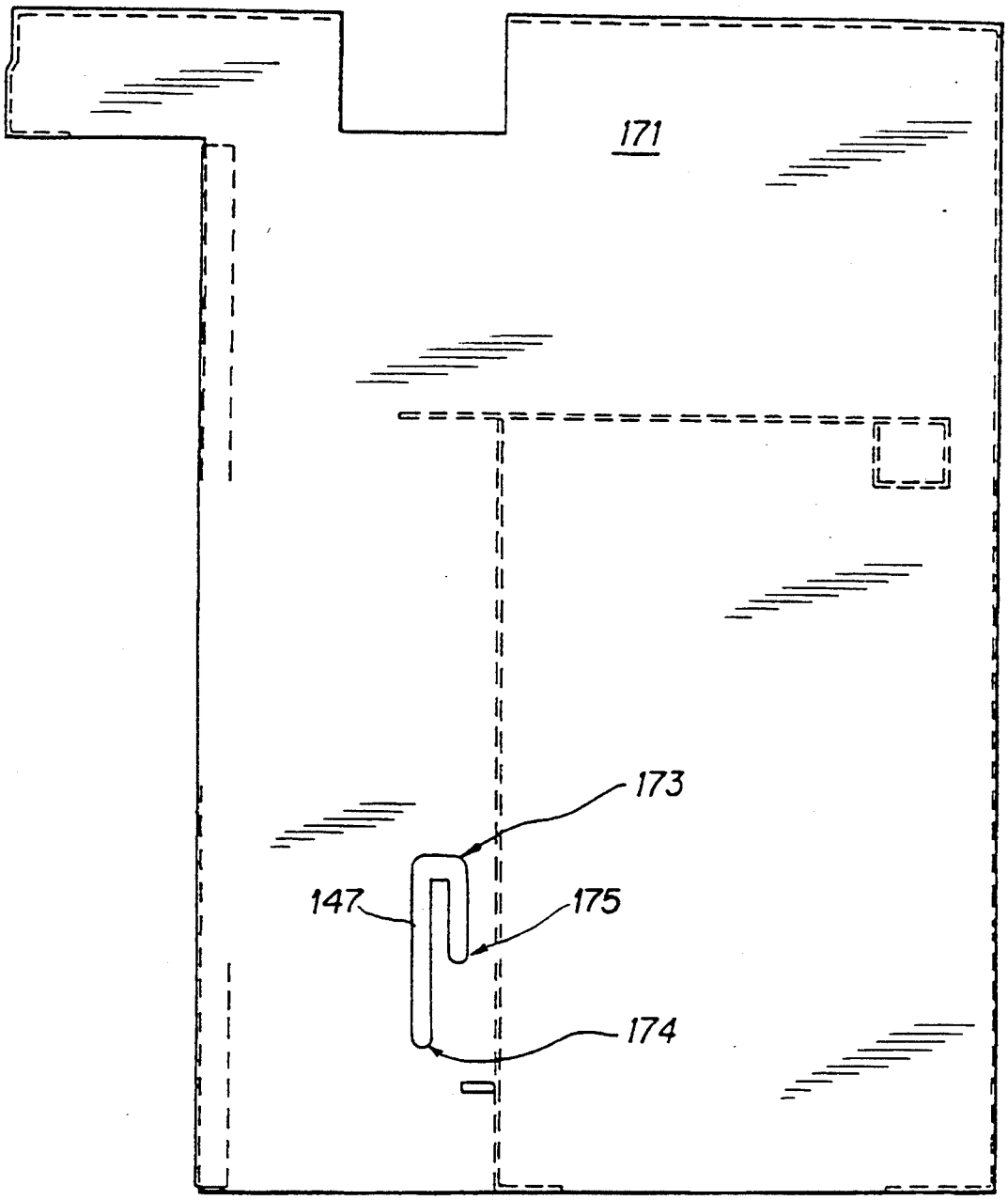
FIG. 10 is a right-side elevation view of FIG. 4.
Figure 11:
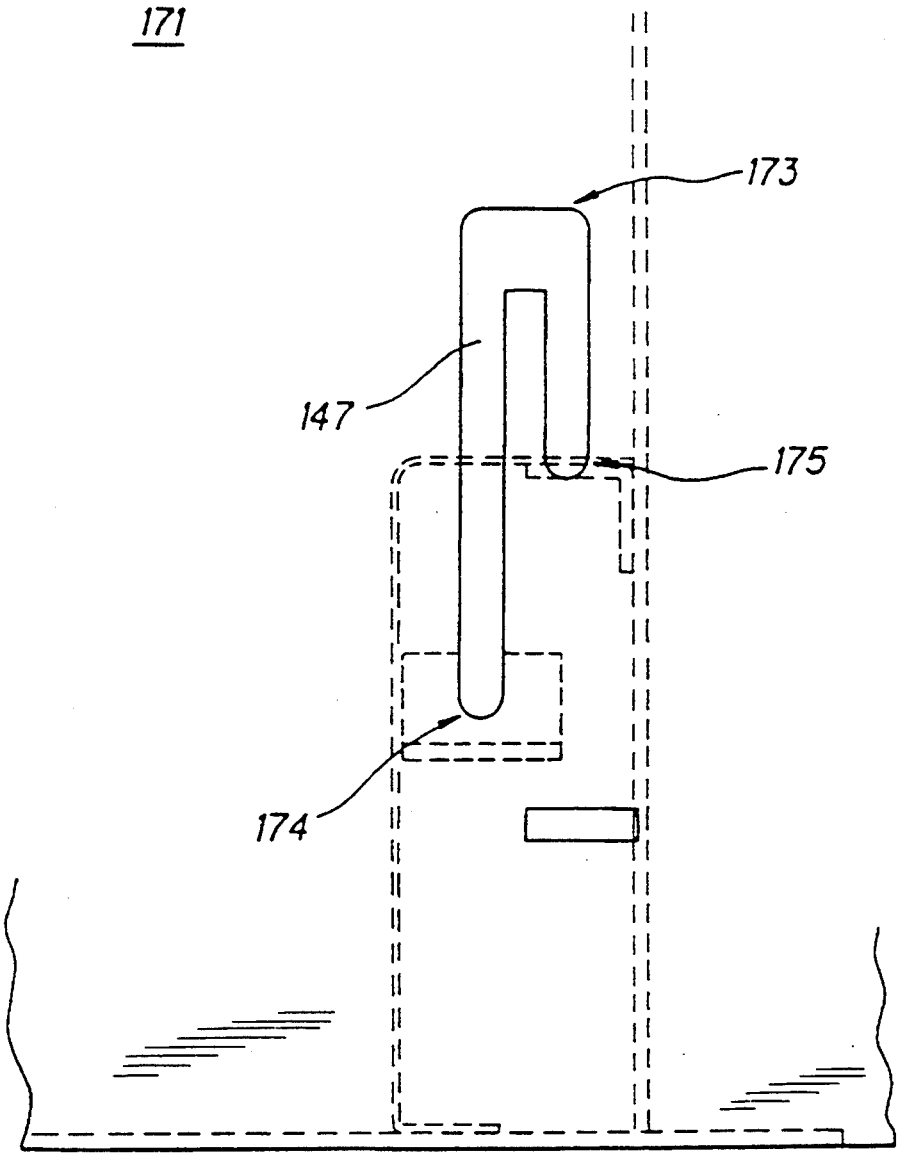
FIG. 11 is an enlarged view showing an essential part of FIG. 10.
Figure 12:
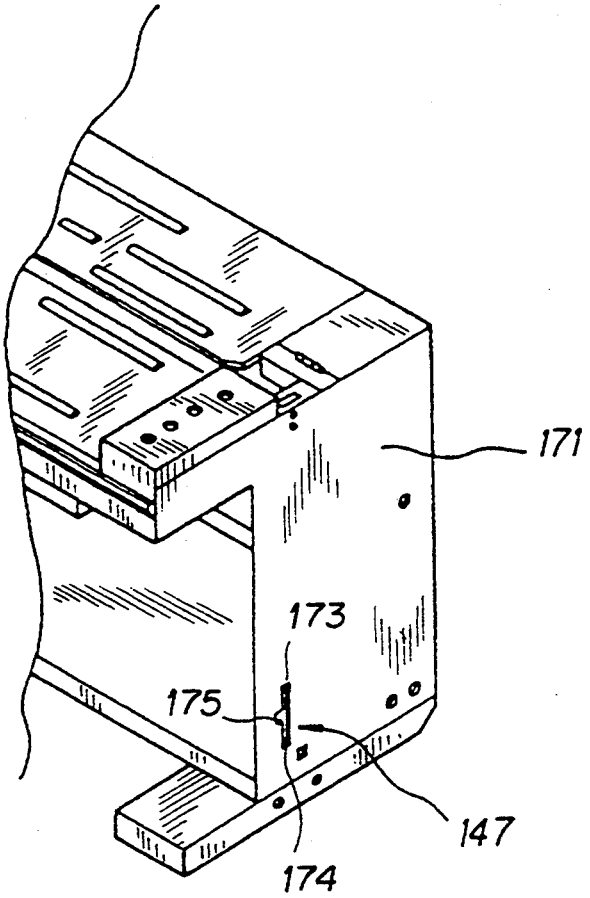
FIG. 12 is a fragmentary perspective view showing another embodiment of a band charging apparatus for a packing machine according to the present invention.

The packing machine A includes an outer wall 171, which is formed with a cutout 147. The cutout 147 is formed into a substantially inverted J-shape which extends in a vertical direction of the outer wall 171, as shown in FIGS. 10 and 11. The handle lever 146 has the other end or an upper end portion outwardly extending from the packing machine A through the cutout 147. The upper end portion of the handle lever 146 is provided with a knob 109. The inverted J-shaped cutout 147 formed as described above has a lowermost point 174 defined by a lower end of the inverted J-shape, an intermediate point 175 defined by an upper end of the inverted J-shape, and an uppermost point 173 defined by a bent portion of the inverted J-shape.

When the handle lever 146 is positioned at the uppermost point 173 of the cutout 147, the wire tube unit acts to advance the rods 129a and 129b and the guide plates A10 are kept closed. At this time, the pool touch roller A9 is kept separated from the pool feed roller A8. When the handle lever 146 is positioned at the intermediate point 175 of the cutout 147, the rods 129a and 129b are kept at a retreated position and the pool touch roller A9 is kept separated from the pool feed roller A8. Also, when the handle lever 146 is located at the lowermost point 175; the rods 129a and 129b are kept retreated, however, the pool touch roller A9 is kept pressedly contacted with the pool feed roller A8. In order to prevent force at which the pool touch roller A9 is pressedly contacted with the pool feed roller A8 from being excessively increased, a stopper 153 (FIG. 4) is provided below the cutout 147. In the illustrated embodiment, the stopper 153 comprises a bolt, which is fixed through a nut on a bracket 154 mounted on the outer wall 171 of the packing machine A in a manner to be positionally variable. Thus, the above-described force at which the pool touch roller A9 is pressedly contacted with the the pool feed roller A8 can be adjusted as desired by adjusting the position of the stopper 153.

Now, the manner of operation of the band charging apparatus C of the illustrated embodiment constructed as described above will be described.

Generally speaking, the band charging apparatus C is operated in order to unwind the band B from the reel A1 and then feed it into the packing machine A for the purpose of charging the band in the band feeding and tightening apparatus A6.

For this purpose, first of all, the handle lever 146 is positioned at the intermediate point 175 of the cutout 147 (FIG. 10). This causes the pool touch roller A9 to be separated from the pool feed roller A8, so that the distal end of the band B may be introduced from the band inlet A7 (FIG. 4) through a gap between the pool touch roller A9 and the pool feed roller A8.

Then, the handle lever 146 is moved to the uppermost point 173 of the cutout 147. This causes the rods **129*a* and 129*b* advance to force the guide plates A10, so that the two guide plates A10 are closed to form the band guide path 53. The guide plates A10 are kept closed by means of the magnets 66*a* and 66*b***.

Subsequently, when the handle lever 146 is positioned at the lowermost point 174 of the cutout 147, the rods **129*a* and 129*b* are retreated through the wire tube unit as shown in FIG. 6. Also, the pool touch roller A9 is pressedly contacted with the pool feed roller A8 through the pool roller spring 150. Further, the guide plates A10 are kept closed by an action of the magnets 66*a* and 66*b* irrespective of retreating of the rods 129*a* and 129*b*, resulting in the band guide path 53** being maintained.

The pool motor 37 continues rotations in advance of pressed contacting of the pool touch roller A9 with the pool feed roller A8, so that the band B is fed through the pool chute 76 into the band chute 79 and then fed through the band guide path 53 to the band feeding and tightening apparatus A6. Then, the band is still continuously fed toward the band feeding and tightening apparatus A6 by rotation of the pool feed roller A8, resulting in being excessive in the band guide path 53. The surplus band undulates in the band guide path 53, to thereby outwardly urge the guide plates A10. Force at which the band urges the guide plates is proportional to nerve of the band. Attracting force of the magnets **66*a* and 66*b* is set to be small as compared with nerve of the band B, so that the guide plates A10 are moved in a direction of being separated from each other or rendered open. This causes the band B to rush out of the band guide path 53 which have been rendered open by nerve of the band B, resulting in the band being stored in the pool box A5. In this instance, the band chute 79 includes a slanting portion formed so as to obliquely upwardly extend as shown in FIG. 4**, so that the band B is stored in only the pool box A5 without entering the back pool box A11.

Release of the band guide path 53, as described above, is automatically carried out by nerve of the band, therefore, it is not required that an operator releases the guide plates A10. Also, release of the band guide path 53 is carried out at a good timing, namely, immediately after the band is fed to the band feeding and tightening apparatus A6 and charged therein. Thus, the band charging apparatus of the illustrated embodiment effectively prevents jamming of the band due to delay of the timing as encountered with the prior art.

The band B which is temporarily stored in the pool box A5 as described above is then fed to a circumference of the package A5 by means of the band feeding and tightening apparatus A6. Then, when the band is drawn back by the band feeding and tightening apparatus A6, it is stored in the back pool box A11. Then, the band is subject to tightening and cutting.

After the band B is cut, it is fed to the arch structure A3 again. Then, it is fed to a circumference of the next package A15 which is subsequently placed on the table A2.

In the illustrated embodiment, the band guide path 53 is defined by the two guide plates A10. Alternatively, it may be defined by movably arranging only one such guide plate. More particularly, the embodiment may be constructed in such a manner that one of the guide plates A10 is fixed so as to be kept closed and the other guide plate is openably or pivotally arranged. In this instance, feeding of the band to the back pool box A11 is carried out though an intake port provided at the box A11.

Also, in the illustrated embodiment, the back pool box A11 as well as the pool box A5 is provided. Alternatively, the embodiment may be so constructed that the pool box A5 may act also as the back pool box A11, to thereby eliminate the latter.

Moreover, in the illustrated embodiment, the cutout 147 through which the handle lever 146 is operated is formed into a substantially inverted J-shape. Alternatively, it may be formed so as to substantially linearly extend in a vertical direction of the outer wall 171 of the packing machine A. The intermediate point 175 is defined at a central position in the vertical direction.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A band charging apparatus for a packing machine which is adapted to feed a band unwound from a reel to a pool box by means of the band charging apparatus for temporarily storing the band in the pool box, feed the stored band to a band feeding and tightening apparatus by means of the band charging apparatus for charging the band feeding and tightening apparatus with the band, feed the band to a circumference of a package by means of the band feeding and tightening apparatus, draw back the band by means of the band feeding and tightening apparatus while gripping a distal end of the band for tightly winding the band on the package, bond an overlapped portion of the band, and cut a portion of the band wound on the package from the remaining part of the band, comprising:

a pool feed roller for carrying out feeding of the band to the pool box;

a pool touch roller arranged so as to access to said pool feed roller through the band;

accessing means for accessing said pool touch roller to said pool feed roller, guide plates having a first position in which a closed band guide path is defined in the pool box when the band is set for charging of the band in the band feeding and tightening apparatus;

a first mechanism for enabling pivotal rotation of at least one of said guide plates about an axis substantially parallel to said band guide path to a second position in which said band guide path is open;

a second mechanism coupled to said accessing means for moving said at least one guide plate from said second position to said first position to close said band guide path upon actuation of said accessing means to access said pool touch roller to said pool feed roller; and a third mechanism for releasably maintaining said at least one guide plate in said first position closing said band guide path such that said at least one guide plate is movable to said second position when the band is excessively fed to said band guide path to thereby open said band guide path.

2. A band charging apparatus as defined in claim 1, wherein said second mechanism includes at least one rod arranged to move between a first position and a second position;

said rod being movable from said first position to said second position to cause said at least one guide plate to close said band guide path and then being returned to said first position; and said third mechanism comprises at least one magnet for maintaining said band guide path closed.

3. A band charging apparatus as defined in claim 2, wherein the movement of said rod is carried out in association with accessing of said pool touch roller to said pool feed roller.

4. A band charging apparatus as defined in claim 3, wherein said accessing means comprise a movable handle lever coupled to said pool touch roller for moving said pool touch roller to access to said pool feed roller, the apparatus further comprising a wire tube unit coupled to said handle lever and to said rod such that movement of said handle lever to move said pool touch roller to access to said pool feed roller causes said rod to move from said first position to said second position.

5. The band charging apparatus of claim 1, wherein said third mechanism comprises a magnet arranged on each of said guide plates such that said magnets are in opposed relationship when said guide plates are in said first position.

6. The band charging apparatus of claim 1, wherein said second mechanism comprises a spring-biased rod which acts to move said at least one guide plate from said second position to said first position to close said band guide path.

7. The band charging apparatus of claim 1, wherein said band guide path is defined by two of said guide plates, said first mechanism enabling pivotal rotation of both of said guide plates about an axis substantially parallel to said band guide path, said second mechanism comprising means for moving both of said guide plates individually from said second position to said first position, and said third mechanism releasably maintaining both of said guide plates in said first position closing said band guide path.

8. The band charging apparatus of claim 1, wherein said first mechanism comprises a fixed plate and a hinge, said hinge having a first portion mounted on said plate and a second portion coupled to said at least one guide plate.

9. A band charging apparatus for a packing machine having a pool box in which the band is pooled, comprising:

a pool feed roller for feeding the band to the pool box;

a pool touch roller arranged opposite said pool feed roller to access said pool feed roller through the band;

accessing means for accessing said pool touch roller to said pool feed roller, at least one guide plate defining in part a closed band guide path in the pool box when the band is set for charging of the band into a band feeding and tightening apparatus;

hinge means for enabling pivotal rotation of said guide plate about an axis substantially parallel to said band guide path to a position in which said band guide path is open;

displacement means coupled to said accessing means for moving said guide plate from the position in which said band guide path is open to a position in which said band guide path is closed upon actuation of said accessing means to access said pool touch roller to said pool feed roller; and means for releasably maintaining said guide plate in the position closing said band guide path whereby said guide plate is movable to open said band guide path when the band is excessively fed to said band guide path.

* * * * *